US007300342B2

(12) United States Patent
Thomas et al.

(10) Patent No.: US 7,300,342 B2
(45) **Date of Patent: *Nov. 27, 2007**

(54) SCRATCH REMOVAL DEVICE AND METHOD

(75) Inventors: Jonathan P. Thomas, Maple Lake, MN (US); Keith A. Beveridge, Edina, CA (US); Chad James Olson, Blaine, MN (US); David Osland, Minneapolis, MN (US)

(73) Assignee: TCG International Inc., Burnaby (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/546,172

(22) Filed: Oct. 11, 2006

(65) Prior Publication Data

US 2007/0077864 A1 Apr. 5, 2007

Related U.S. Application Data

(63) Continuation of application No. 11/240,129, filed on Sep. 30, 2005, now Pat. No. 7,137,872.

(51) Int. Cl.
*B24B 1/00* (2006.01)

(52) U.S. Cl. ..... 451/548; 451/36; 451/21; 451/530

(58) Field of Classification Search ..... 451/21, 451/36, 548, 527, 530, 539, 550, 427, 428
See application file for complete search history.

(56) References Cited

U.S. PATENT DOCUMENTS

| | | | | |
|---|---|---|---|---|
| 3,386,214 | A * | 6/1968 | Shoemaker | 451/488 |
| 4,037,367 | A * | 7/1977 | Kruse | 451/551 |
| 4,622,780 | A | 11/1986 | Tingley | |
| 4,709,513 | A | 12/1987 | Tingley | |
| 4,918,872 | A | 4/1990 | Sato et al. | |
| 5,243,790 | A | 9/1993 | Gagne | |
| 5,645,469 | A * | 7/1997 | Burke et al. | 451/41 |
| 6,090,475 | A * | 7/2000 | Robinson et al. | 428/212 |
| 6,814,656 | B2 | 11/2004 | Rodriguez | |

FOREIGN PATENT DOCUMENTS

| | | |
|---|---|---|
| WO | WO 96/29179 | 9/1996 |

* cited by examiner

*Primary Examiner*—Joseph J. Hail, III
*Assistant Examiner*—Robert Scruggs
(74) *Attorney, Agent, or Firm*—Merchant & Gould P.C.

(57) ABSTRACT

A polishing wheel including a lower polishing surface and defining a different color from a secondary portion of the polishing wheel, so as to indicate wear of the polishing surface. The polishing surface includes a plurality of main radial flutes extending from a central passage to an outer edge. A reduced profile for the main radial flutes is provided adjacent to the outer edge. A plurality of secondary radial flutes is provided extending from the outer edge, but not in communication with either the central passage or the main radial flutes.

10 Claims, 4 Drawing Sheets

SCRATCH REMOVAL DEVICE AND METHOD

CROSS REFERENCE TO RELATED APPLICATION

This application is a continuation of application Ser. No. 11/240,129, filed Sep. 30, 2005 now U.S. Pat. No. 7,137, 872, which application is incorporated herein by reference.

FIELD OF THE INVENTION

The present invention relates to apparatus and methods for removing scratches from smooth surfaces such as glass. More specifically, the present invention relates to a polishing wheel and method for use in removing the scratches.

BACKGROUND OF THE INVENTION

Rotary tools are used to grind and polish glass to remove scratches and other damage from the surface of the glass. After processing the glass, such as windshields, it is desirable to leave the glass so the scratch or other damage is less visible and/or less likely to affect viewing through the glass. U.S. Pat. Nos. 4,709,513 and 4,622,780 show various tools for use in polishing glass.

Further improvements are desired for the rotary tools and methods used to polish glass.

SUMMARY OF THE INVENTION

The present invention relates to a polishing wheel including a body defining a central longitudinal axis and a central passage coaxial with the longitudinal axis. The body is mountable to a rotating polishing device. The body of the polishing wheel has a lower polishing surface including a planar portion. The lower polishing surface is defined by a lower portion of the body. The body further has an upper portion disposed on an opposite side of the lower portion from the lower polishing surface. The lower portion and upper portion are each made from a first material having a common component. The upper portion and the lower portion are provided with different colors, wherein wearing away of the lower portion during the polishing operation is more visible due to the color differential between the upper and lower portions.

The present invention also relates to a polishing wheel wherein a lower polishing surface includes a plurality of main flutes extending from the central passage to an outer edge of the lower polishing surface. Further flutes extend from the outer edge of the lower polishing surface and terminate without communicating with the central passage or the main flutes.

DETAILED DESCRIPTION OF THE PREFERRED EMBODIMENT

Figure 1:
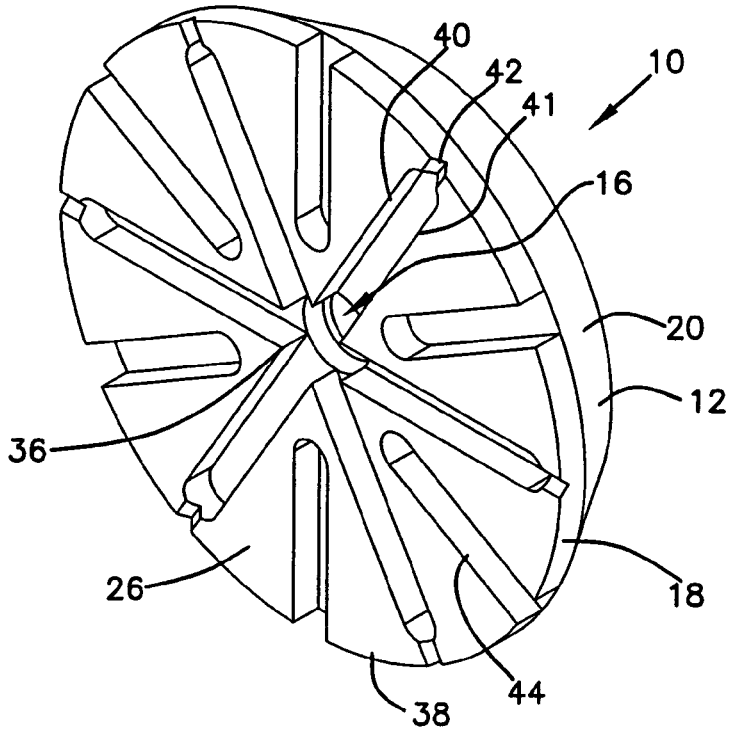
FIG. 1 is a perspective view of a polishing wheel in accordance with the present invention.
Figure 2:
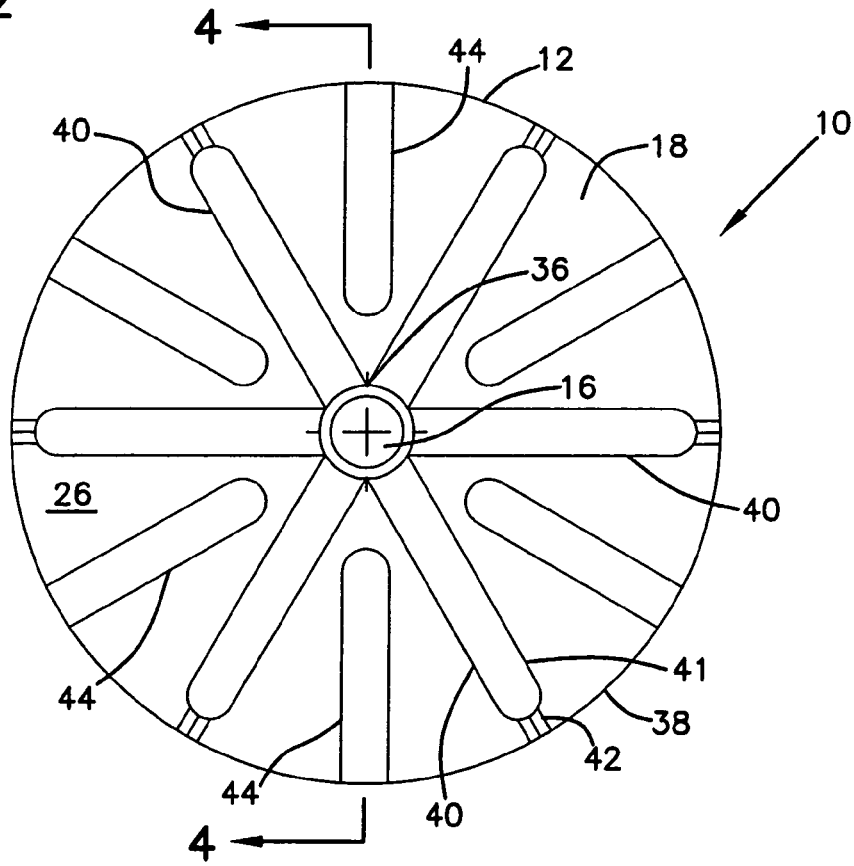
FIG. 2 is a bottom view of the polishing wheel of FIG. 1.
Figure 3:
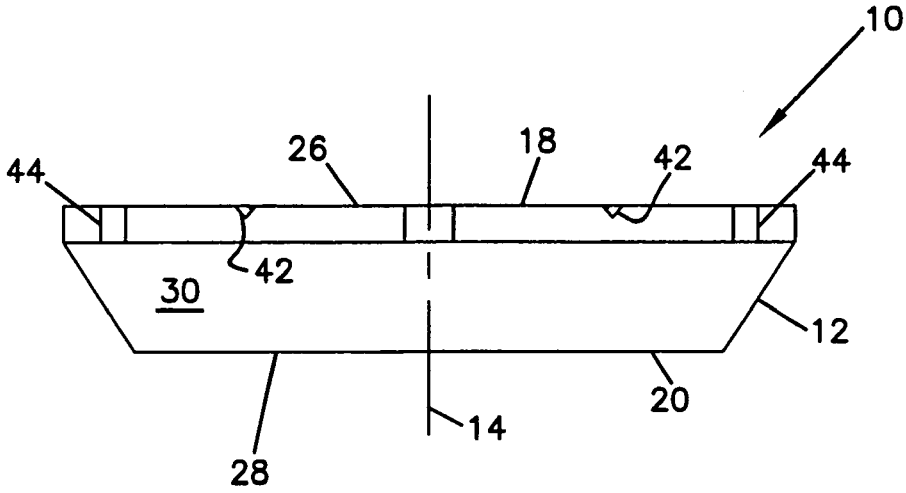
FIG. 3 is a side view of the polishing wheel of FIG. 1.
Figure 4:
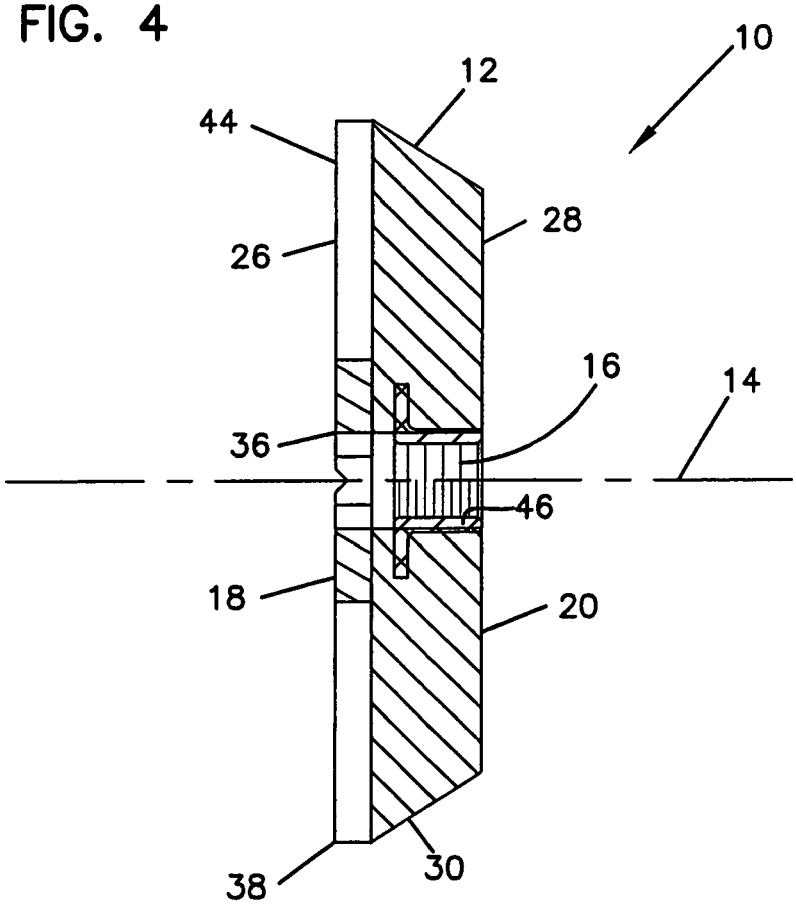
FIG. 4 is a cross-sectional side view of the polishing wheel of FIG. 1, taken along lines 4-4 of FIG. 2.

Referring to FIGS. 1-4, one embodiment of a polishing wheel 10 is shown. Polishing wheel 10 is usable in the apparatus and methods described in U.S. Pat. Nos. 4,622, 780 and 4,709,513, the disclosures of which are incorporated by reference.

Polishing wheel 10 includes a body 12 defining a central longitudinal axis 14. During use, body 12 is rotated about longitudinal axis 14. Polishing wheel 10 is designed for use with a center slurry feed tool like that described in the above noted patents.

Body 12 includes a central passage 16 which is coaxial with longitudinal axis 14. Central passage 16 is in fluid communication with the slurry source provided by the rotating tool as described in the above noted patents.

Body 12 further includes a lower portion or layer 18, and an upper portion or layer 20. Lower portion 18 defines a lower polishing surface 26. Upper portion 20 is located on an opposite side of lower portion 18 from polishing surface 26. An upper surface 28 is defined by upper portion 20 and faces in an opposite direction to polishing surface 26. Body 12 further defines a side surface extending between polishing surface 26 and upper surface 28. Polishing surface 26 extends from an inner edge 36 adjacent to central passage 16 to an outer edge 38.

Lower portion 18 includes main flutes 40 extending from central passage 16 at inner edge 36 to outer edge 38. In the preferred embodiment, main flutes 40 extend radially. In one preferred embodiment, main flutes 40 include reduced profile exit passages 42 for providing control of slurry outflow. Generally, a main portion 41 of main flutes 40 extends completely through lower portion 18. Exit passages 42 are shown in the illustrated embodiment as small v-grooves formed in lower portion 18. Main flutes 40 are arranged radially relative to longitudinal axis 14. Main flutes 40 are further arranged to be equally spaced from each other.

Secondary flutes 44 are also provided in lower portion 18. Secondary flutes 44 extend from outer edge 38 toward central passage 16. However, secondary flutes 44 terminate before communicating with central passage 16 or main flutes 40. In the illustrated embodiment, secondary flutes 44 extend all the way through lower portion 18. Secondary flutes 44 are radially arranged, and are equally spaced about polishing surface 26.

Central passage 16 includes a T-nut 46 which permits mounting of polishing wheel 10 to the rotating tool. Preferably, an inner surface of T-nut 46 is threaded. Spikes or other projections on T-nut 46 can be added to assist with holding T-nut 46 in position.

Preferably, body 12 is made from a moldable material. In the preferred embodiment, lower portion 18 and upper portion 20 are made from a common material, such as a moldable elastomeric material. Lower portion 18 is further provided with an impregnated material to facilitate polishing. Preferably, the impregnated material is a particulate. In one preferred embodiment, the particulate material is cerium oxide.

Upper portion 20 is not designed to polish. Therefore, no impregnated material for polishing is used in upper portion 20 in the preferred embodiment.

Preferably, lower and upper portions 18, 20 are molded together such that the layers are heat fused together. One preferred elastomeric material is expanded urethane. LP66 designation by Universal Photonics of Hicksville, N.Y. is one material for layer 18 that can be used. LP66 material includes impregnanted cerium oxide.

To indicate wear of lower portion 18 to the user, a colorant is added to one or both of lower portion 18 and upper portion 20. The colorant or colorants are selected so as to provide a visual contrast between lower portion 18 and upper portion 20. Such contrast provides a visual indication to the user when lower portion 18 is worn away, or is otherwise sufficiently removed to no longer be desired for continued use in further polishing operations. For example, lower portion 18 can be rust in color, and upper portion 20 can be gray.

Secondary flutes 44 reduce the lower surface area and allow for an increase in the workload on the wheel by minimizing the square area in contact with the surface being polished. Such increase in the workload will allow the polishing operation to be accomplished faster. The arrangement of flutes as shown in the Figures also helps to more evenly distribute the polishing material across the polishing surface 26, to minimize distortion. One problem with prior art devices is that inexperienced users can apply excessive pressure and cause uneven polishing, and possibly distortion, to the glass. By providing an arrangement of polishing surface 26 as described above, less distortion and less uneven polishing results.

Figure 7:
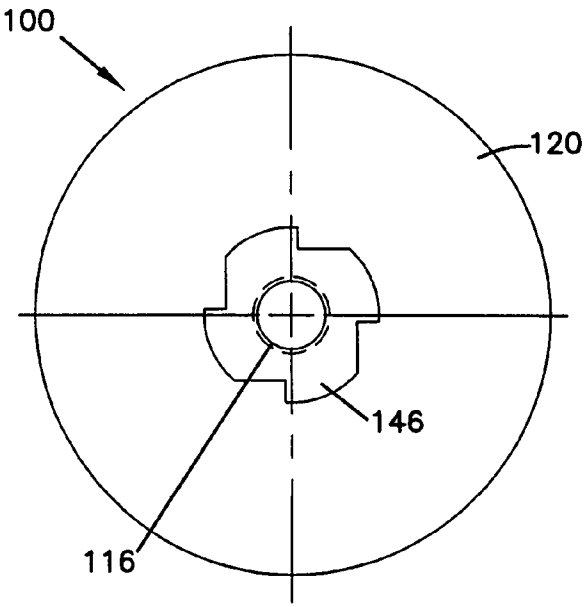
FIG. 7 is a top view of the polishing wheel of FIG. 5.
Figure 6:
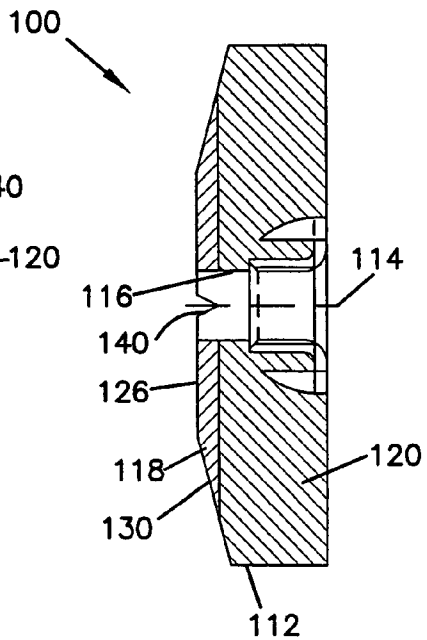
FIG. 6 is a cross-sectional side view of the polishing wheel of FIG. 5, taken along lines 6-6 of FIG. 5.
Figure 5:
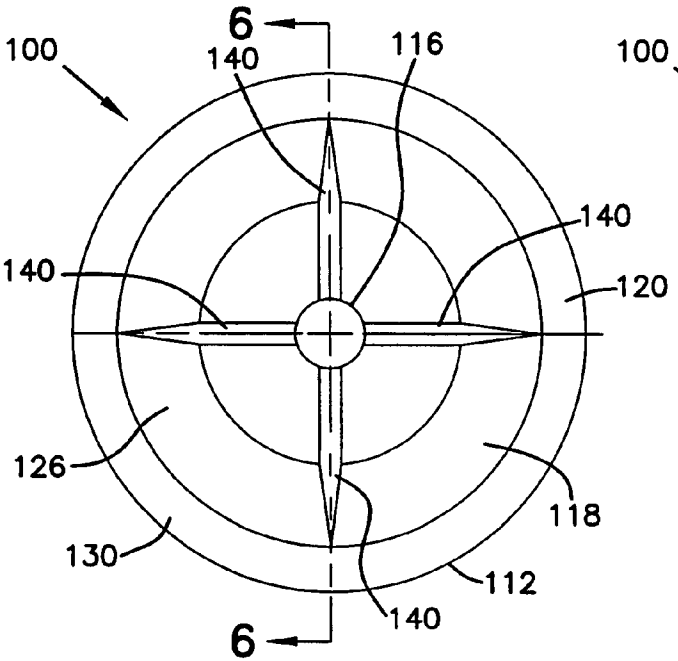
FIG. 5 is a bottom view of an alternative embodiment of a polishing wheel.

FIGS. 5-7 show an alternative embodiment of a polishing wheel 100 including a body 112 having some similar features as polishing wheel 10. Polishing wheel 100 includes a smaller polishing surface 126. Polishing wheel 100 is useful for polishing smaller areas, or areas near the edges of windshields.

Body 112 includes a central axis 114 and a central passage 116 including a T-nut 146 which permits mounting of polishing wheel 100 to the rotating tool. Lower portion 118 includes a different color from upper portion 120. Body 112 includes a side taper 130 which tapers down to polishing surface 126.

In the illustrated embodiment, polishing wheel 100 includes a plurality of radially extending flutes 140 extending from central passage 116 to an outside edge of lower portion 118.

Figure 10:
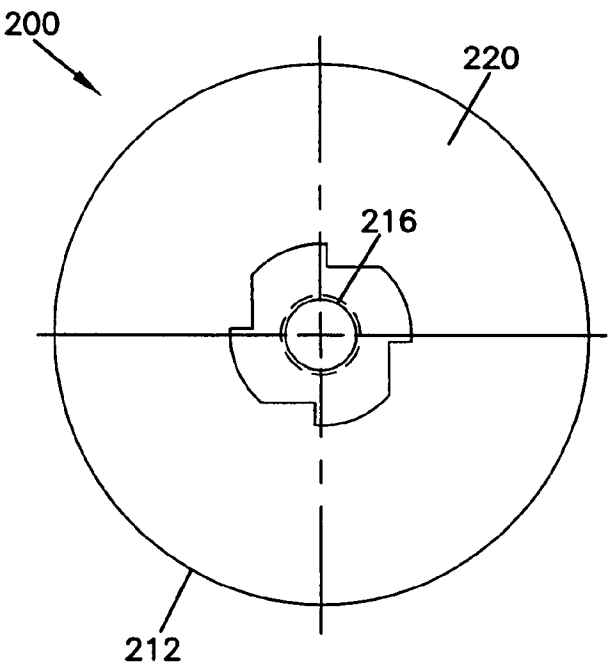
FIG. 10 is a top view of the polishing view of FIG. 8.
Figure 9:
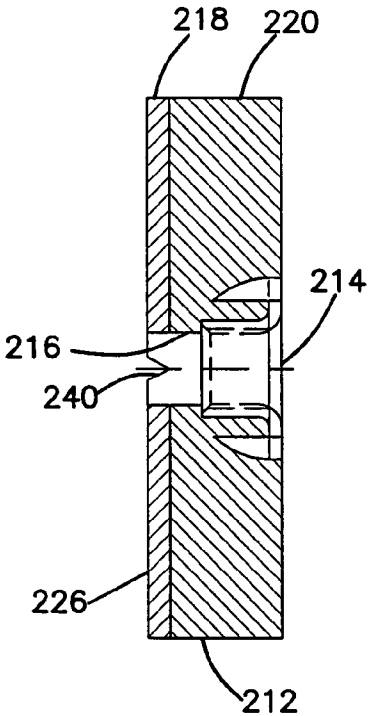
FIG. 9 is a cross-sectional side view of the polishing view of FIG. 8, taken along lines 9-9.
Figure 8:
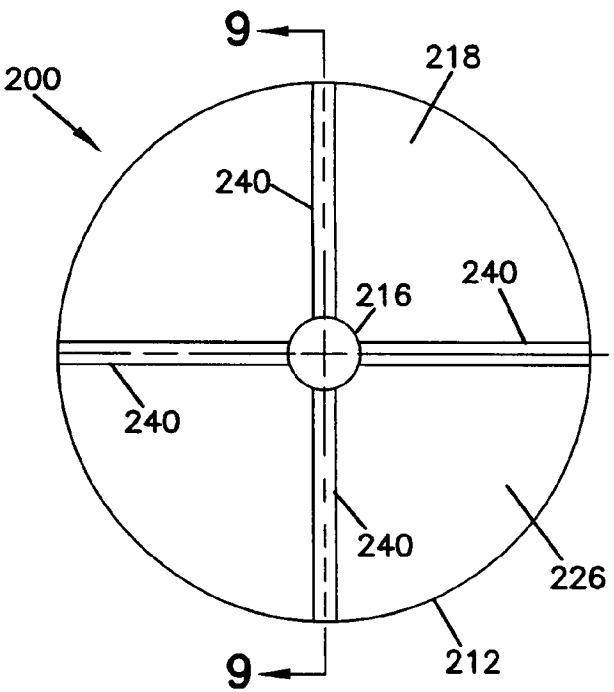
FIG. 8 is a bottom view of a further alternative embodiment of a polishing wheel.

A further alternative embodiment of a polishing wheel 200 is shown in FIGS. 8-10. Body 212 is more cylindrical in shape relative to the earlier described embodiments. Body 212 includes a central axis 214 and a central passage 216 including a T-nut 246 which permits mounting of polishing wheel 200 to the rotating tool. Body 212 includes a lower portion 218 having a different color from upper portion 220. Polishing surface 226 includes a plurality of radially extending flutes 240 extending from central passage 216 to an outside edge of lower portion 218.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A polishing wheel comprising:

a body defining a central longitudinal axis and a central passage coaxial with the longitudinal axis, the body mountable to a rotating polishing tool;

the body having a lower polishing surface defining a planar portion;

wherein the lower polishing surface includes a plurality of main radial flutes extending from the central passage to an outer edge of the lower polishing surface, which defines a maximum diameter of the lower polishing surface to define an open fluid flow path from the central passage to the outer edge;

wherein secondary radial flutes are provided in the lower polishing surface extending from the outer edge and terminating in an area before the central passage, and further wherein the secondary radial flutes are not in direct flow communication with the main radial flutes;

wherein the main radial flutes have a reduced profile exit passage radially inward and adjacent to the outer edge, relative to a main portion of the main radial flutes disposed radially inwardly between the central passage and the exit passage, wherein the exit passages having a smaller cross-sectional area than the main portion of the main radial flutes.

2. The polishing wheel of claim 1, wherein six main radial flutes are provided, and six secondary radial flutes are provided, equally spaced around the longitudinal axis.

3. The polishing wheel of claim 1, wherein the exit passages have a smaller depth from the planar portion of the lower polishing surface, relative to a depth of the main portion of the main radial flutes.

4. The polishing wheel of claim 3, wherein the exit passages are shorter than the main portions of the main radial flutes in the radial direction.

5. The polishing wheel of claim 1, wherein the body has a lower portion defining the lower polishing surface, and an upper portion, the upper portion disposed on an opposite side of the lower portion from the lower polishing surface;

the lower portion including a first material and having a first color;

the upper portion including the same first material, and having a second color visually different from the first color;

the lower portion including a polishing material impregnated in the first material, wherein the upper portion does not include the polishing material, wherein the first material is a molded polymeric material;

the body including a threaded nut with an outer projection embedded in the upper portion, wherein the threaded nut is not positioned in the lower portion, the threaded nut including an inner threaded passage coaxial with the central passage and mountable to the rotating polishing tool.

6. The polishing wheel of claim 5, wherein the polymeric material is a urethane material, and wherein the polishing material is cerium oxide.

7. A polishing wheel comprising:

a body including at least a lower portion of wearable polishing material;

a polishing surface on a lower surface of the body;

a central fluid passage through the body, the central fluid passage including an internally threaded portion;

a plurality of recessed fluid passages extending from the central fluid passage across the polishing surface to an outer side surface of the polishing surface, which defines a maximum diameter of the polishing surface to define fluid flow paths from the central fluid passage to the outer side surface;

each recessed fluid passage including a reduced profile exit passage within the recessed fluid passage;

wherein each reduced profile exit passage has a reduced cross-sectional area relative to the recessed fluid passage disposed inwardly from the reduced profile exit passage;

wherein each reduced profile exit passage has a reduced depth relative to the recessed fluid passage disposed inwardly from the reduced profile exit passage.

8. The polishing wheel of claim 7, wherein the recessed fluid passages are linear and radially arranged on the polishing surface.

9. The polishing wheel of claim 8, further comprising recessed channels in the polishing surface extending from a location not in communication with the central fluid passage radially to the outer side surface.

10. A method of polishing a surface comprising a steps of:

a) providing a polishing wheel including:

i.) a body;

ii.) a polishing surface;

iii.) a central fluid passage through the body;

iv.) a plurality of passages extending from the central fluid passage across the polishing surface to an outside edge of the polishing surface, which defines a maximum diameter of the polishing surface;

v.) a plurality of cutouts in the polishing surface not in direct flow communication with the plurality of passages, wherein the cutouts extend to the outside edge of the polishing surface;

b) providing flow restriction passages within the plurality of passages, wherein the flow restriction passages are adjacent to the outside edge of the polishing surface;

c) passing polishing fluid from the central fluid passage into the plurality of passages;

d) restricting fluid flow through the plurality of passages by the flow restriction passages;

e) rotating the body about the central longitudinal axis;

f) polishing the surface with rotation of the polishing wheel and with the polishing fluid passing from the central fluid passage through the plurality of passages to the outside edge of the polishing surface.

* * * * *